US005264081A

United States Patent [19]

Honnorat et al.

[11] Patent Number: 5,264,081

[45] Date of Patent: Nov. 23, 1993

[54] FORGERY-PROOF SAFETY PAPER

[75] Inventors: André Honnorat, Annecy; Claude R. Riou, Menthon St. Bernard, both of France

[73] Assignee: Societe Anonyme: Aussedat-Rey, France

[21] Appl. No.: 528,599

[22] Filed: May 24, 1990

[30] Foreign Application Priority Data

Jun. 1, 1989 [FR] France ..... 89 07497

[51] Int. Cl.[5] ..... D21H 21/46

[52] U.S. Cl. ..... 162/140; 162/158; 162/162; 427/7; 428/916; 252/583; 252/586

[58] Field of Search ..... 162/140, 158, 162; 427/7; 428/916; 252/583, 586, 408.1

[56] References Cited

U.S. PATENT DOCUMENTS

| | | | |
|---|---|---|---|
| 1,864,116 | 6/1932 | Bausch et al. | 162/140 |
| 3,464,841 | 9/1969 | Skofronick | 162/140 |
| 3,640,709 | 2/1972 | Kondo et al. | 430/134 |
| 4,136,229 | 1/1979 | Godet et al. | 162/140 |
| 4,362,645 | 12/1982 | Hof et al. | 116/217 |
| 4,725,497 | 2/1988 | Honnorat et al. | 162/140 |

FOREIGN PATENT DOCUMENTS

| | | | |
|---|---|---|---|
| 2365656 | 5/1978 | France | 162/140 |
| 2402739 | 5/1979 | France | 162/140 |
| 2410702 | 8/1979 | France | 162/140 |

*Primary Examiner*—W. Gary Jones
*Assistant Examiner*—Todd J. Burns
*Attorney, Agent, or Firm*—Lerner, David, Littenberg, Krumholz & Mentlik

[57] ABSTRACT

This invention relates to the paper-making domain and especially to a forgery-proof safety paper, which includes on its surface and/or in its mass, at least one compound responding to formula:

(1)

in which:

$R_1$, $R_2$, $R_3$ may be either H, OH, or OR,

R being a hydrocarbon chain, substituted or not, straight, cyclic or aromatic, with A forming one or more cycles, substituted or not. This invention is particularly applicable to forgery-proof safety papers such as cheques or handwritten documents for payment.

8 Claims, No Drawings

FORGERY-PROOF SAFETY PAPER

The invention relates to the domain of papermaking, and especially to a novel forgery-proof safety paper comprising an aromatic product and an aqueous or organic composition useful in particular for rendering a paper forgery-proof.

So-called "safety" papers which are used in particular for making handwritten documents for payment or official documents, such as cheques, travellers' cheques, etc..., must be protected against any attempt at falsifying the writing or stamps borne on the paper, with the aid of any chemical reagent or modern process, such as an ink eraser pencil. Such eraser pencils make it possible to eliminate, cleanly, the colored inks employed at present for handwriting or printing by inking pads.

However, the majority of safety papers available at present on the market react only insufficiently to the attempts at falsification with ink eraser pencils and present the drawback of considerably increasing the costs of the safety papers.

French Patent FR-A-2 365 656 describes a safety paper comprising a chemical sensitizing composition based on an acido-basicity indicator, highly sensitive to the variations in pH. The indicator is selected in particular from the group of phthaleins or sulfo-phthaleins. When the pH rises (due to the action of the eraser pencil), the paper develops a coloration. However, all the products described are delicate to use in paper-making, principally because of their conditions of solubilization, pH, use or of reversibility or stability.

French Patent FR-A-2 399 505 and its Certificate of Addition FR-E-2 402 739 describe a safety paper comprising a chemical sensitizing composition based on a salt of oxypyrene tricarboxylic acid, called Pyranine. The action of an eraser pencil on such papers develops a fluorescent yellow coloration.

The presence of fluorescence in the paper is detrimental in many safety papers, and particularly in those where pigments and fluorescent fibers, necessary for authentication, are introduced.

French Patents FR-A-2 406 027, FR-A-2 427 426 and its Certificate of Addition FR-E-2 432 576, describe a safety paper comprising dinitrophenols which, under the action of an eraser pencil, are colored non-fluorescent yellow.

French Patent FR-A-2 410 702 describes a safety paper comprising a chemical sensitizing composition composed of Pyranine associated with an optical white and with various other compounds. The action of an eraser felt on such a paper leads to a fluorescent yellow coloration.

It is an object of the present invention to propose a compound which, associated with a paper, renders the latter forgery-proof, even by eraser pencils, by instantaneously developing a coloration clearly detectable by the naked eye, this paper being non-fluorescent.

It is another object of the invention to propose a compound which is easy to employ and which, on an industrial scale, leads to paper of lower cost.

The object of the invention is attained with a forgery-proof safety paper, characterized in that it comprises, on its surface and/or in its mass, at least one compound responding to formula:

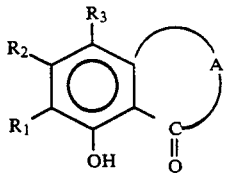

(1)

in which:

$R_1$, $R_2$, $R_3$ may be either H, OH, or OR,

R being a hydrocarbon chain, substituted or not, straight, cyclic or aromatic, and in which A forms one or more cycles, substituted or not.

The compounds have the following preferred substructures:

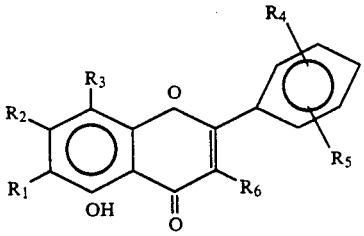

(I)

with:

$R_1$, $R_2$, $R_3$, $R_4$, $R_5$, $R_6$ being either H, OH or OR,

R being a hydrocarbon chain, substituted or not, straight, cyclic or aromatic.

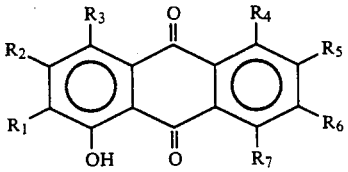

(II)

with:

$R_1$ to $R_7$ being either H, OH or OR,

R being a hydrocarbon chain, substituted or not, straight, cyclic or aromatic.

The invention also relates to a composition for rendering a paper forgery-proof, characterized in that it comprises:

at least one compound responding to formula (1), and at least one coating binding.

The paper may have any fibrous constitution: purely cellulosic or partly synthetic, to which may be added the additives conventional in papermaking, namely: inorganic fillers, various resistance agents, binding agents, resins, shading dyes, neutral, acid or basic sizing products, alumina sulfate for acid sizing or adjustment of the pH, etc...

Numerous compounds may be suitable for carrying out the present invention.

The following are preferred, among those responding to sub-structure (I):

quercetin dihydrate:

-continued
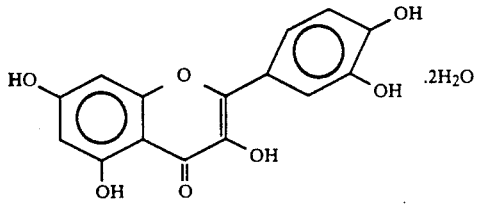
rutin trihydrate:
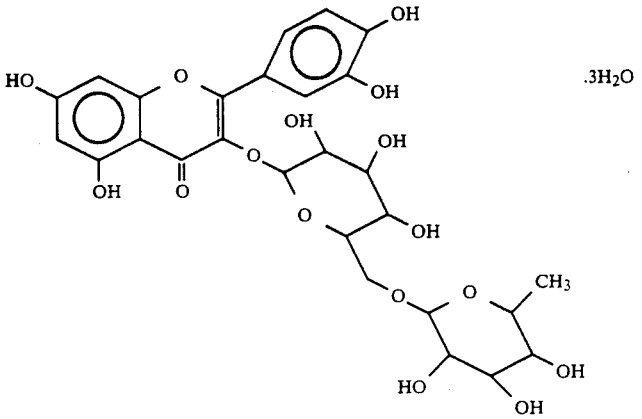
naringin hydrate:
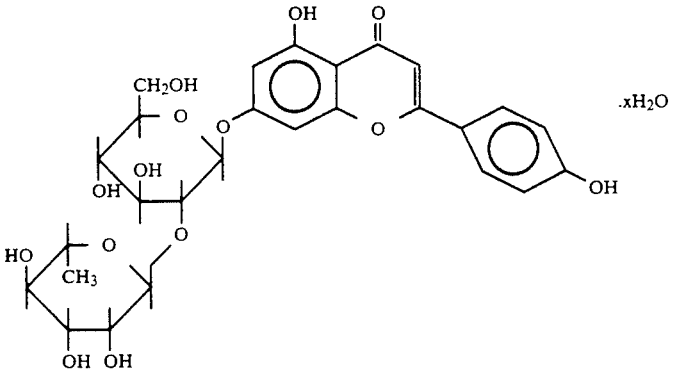
3',5,7 trihydroxy 4' methoxyflavone 7 rutinoside:
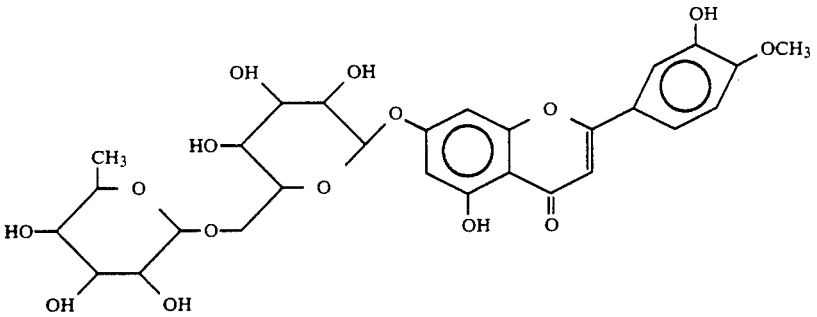
chrysin:
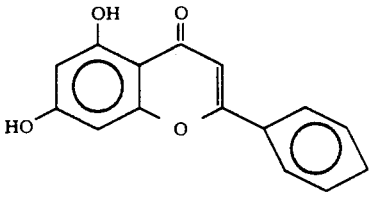

-continued

Tri (2-hydroxy ethyl) 7,3'-4' rutin:

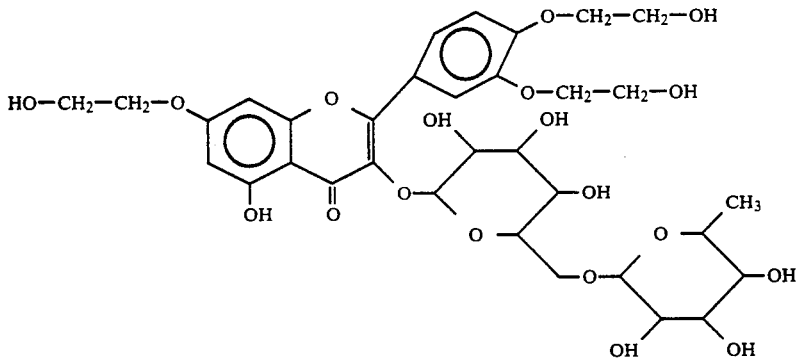

and in those responding to sub-structure (II):

quinizarin:

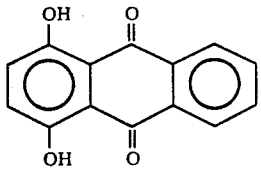

1,8 dihydroxyanthraquinone:

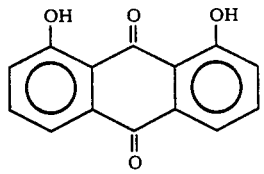

anthrarufin:

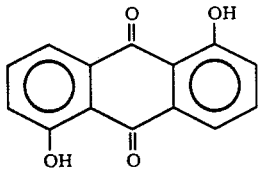

Furthermore, whatever the mode of addition, the paper will preferably comprise at least 0.0001 g/m$^2$ of the compound and, advantageously, between 0.005 and 0.10 g/m$^2$.

The paper may also comprise sensitizing reagents, similar to those already used at the present time in safety papers, for example products ensuring a change in the appearance of the paper by contact thereof with acids, oxidizing reagents or oxido-reducing combinations. In known manner, these products are introduced, either directly on the surface, for example by coating the surface of the paper, or in the mass by an aqueous solution, in which case their retention on the fibers must be ensured, by direct bond or via fixing agents, or in the precipitate, micro-dispersed or pigmentary state.

There is no problem of compatibility between the sensitizers and the products responding to formula (1), on condition that these sensitizers are neither basic nor reducing. In fact, the principal property, forming the subject matter of the invention, issuing from the formula of products (1) being to develop a coloration in the presence of bases or reducing agents (principal components of ink eraser felts), an association of the products issuing from formula (1) with basic or reducing products would lead to a colored paper which is inert with respect to attempts at falsification by a base, a reducing agent or an eraser felt.

These papers may also contain, in their mass, in the pigmentary, dispersed state, one or more water-insoluble but organo-soluble dyes, so as to preserve the writing or mentions borne on these papers from attempts at falsification with the aid of organic solvents. Moreover, these papers may be water-marked or may contain various artifices intended to ensure recognition thereof, such as colored and/or fluorescent fibers, pellets, particles.

The papers are rendered forgery-proof by a process which consists in associating the paper with at least one compound responding to formula (1).

A first modus operandi, in order to render a paper forgery-proof, consists in incorporating the compound of formula (1) during the paper manufacturing process.

A second modus operandi consists in depositing on one or both faces of a sheet of paper, an aqueous composition comprising a compound of formula (1), as defined hereinabove, and a coating binding.

The following coating bindings may be mentioned by way of indication: synthetic or natural polymers with compatible hydroxy terminations, such as starch, polyvinyl alcohol and cellulosic derivatives.

The coating composition preferably comprises, in grams for one liter of water:

| | |
|---|---|
| one or more compounds of formula (1) | 0.1 to 50 g |
| coating binding (depending on the binding agent used) | 10 to 150 g |
| other additives | 0 to 100 g |

These additives may be additives conventionally used in paper-making, namely, for example:

antioxydants, fillers for improving whiteness, products rendering the binding agents insoluble, etc...

A third modus operandi consists in depositing, on one or both faces of a sheet of paper, a composition comprising a compound of formula (1), an organic solvent and a compatible coating binding.

Esters, ketones, alcohols, essences or aromatic compounds may be mentioned as solvent, provided that the products are soluble therein.

However, this third modus operandi results in a paper which does not react to the action of the solvent which was precisely used during this process.

It should be specified that the term "composition" designates the solutions, i.e. the compositions in which the constituents are in the state of solutes, but, also, partially or non-solubilized dispersions.

These compositions may be deposited by means of a coating technique used in paper-making (size-press, systems employing rollers, blades, etc...

The invention also relates to the compositions, colored or not, as such.

EXAMPLE 1

On a paper support containing in mass one or more dispersed organo-soluble dyes, these products being intended to give the paper the sensitivity to the solvents that may be used for falsifying the paper, there is deposited on the surface, by a conventional paper-making technique (size press, roller system), the coating solution comprising per liter of water:

quercetin dihydrate 1 g

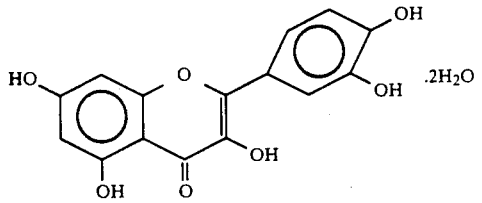

starch 100 g

The coloration obtained with the ink eraser pencils and the bases is yellow.

The paper thus treated reacts, in addition, with the solvents which color the paper differently depending on their nature and on the organo-soluble dyes introduced.

EXAMPLE 2

On a paper support containing in mass the organo-soluble dyes and a product for rendering the paper sensitive to acids (dye for AS cheque of BASF), there is deposited on the surface the coating solution containing per liter:

quercetin dihydrate 0.8 g

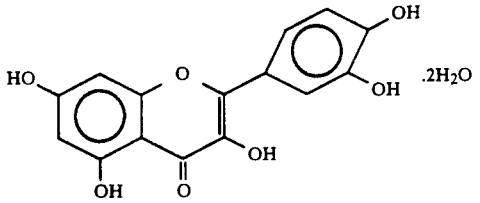

manganese sulfate 3 g starch 100 g

The reactions to the attempts at falsification provoke the following colorations:

pink-red with acids brown with Javel water yellow with bases and ink erasers variable with the solvents, as a function thereof and the organo-soluble dyes introduced.

EXAMPLE 3

On a paper support not containing any organosoluble dyes, there is deposited the following composition:

ethyl acetate 1000 g quercetin dihydrate 1 g

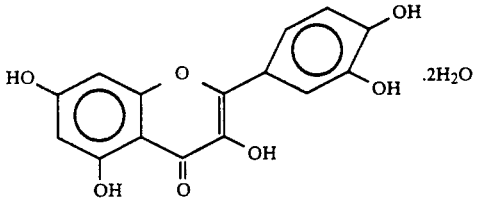

ixan SGR (R) (vinylidene polychloride marketed by SOLVAY) 50 g

The non-fluorescent paper thus obtained reacts in yellow with the eraser felts, reducing agents and bases.

EXAMPLE 4

On a paper support containing in mass reagents (dye for reaction to acids of the type dye AS of BASF) and one or more dispersed organo-soluble dyes, these products being intended to give the paper the sensitivity to acids and the solvents that may be used for falsifying the paper, there is deposited on the surface, by a conventional paper-making technique (size-press, roller systems), the coating solution comprising per liter of water:

rutin trihydrate 6 g

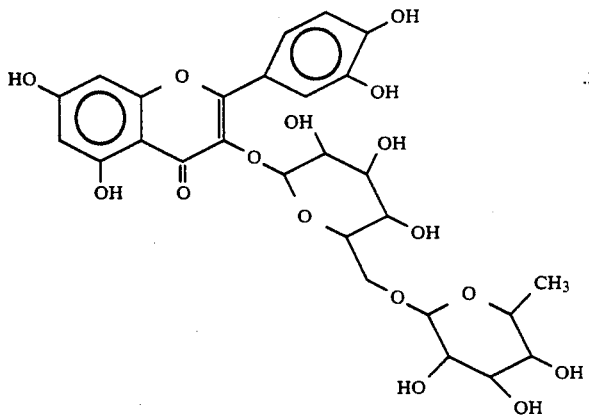

.3H2O polyvinyl alcohol Rhodoviol 30-5 (R) (of RHONE POULENC) 20 g

The instantaneous coloration, obtained with ink eraser pencils, reducing agents and bases, is yellow. The acids lead to a pink coloration and the solvents to colorations which vary depending on the solvent and the dyes introduced in the mass.

EXAMPLE 5

On a paper containing simply a dye dispersed in the mass, it is possible to obtain a yellow coloration with ink eraser felts, bases and reducing agents, and variable colorations with solvents (depending on the solvent and the dye used) with a surfacing solution containing per liter:

naringin hydrate 10 g

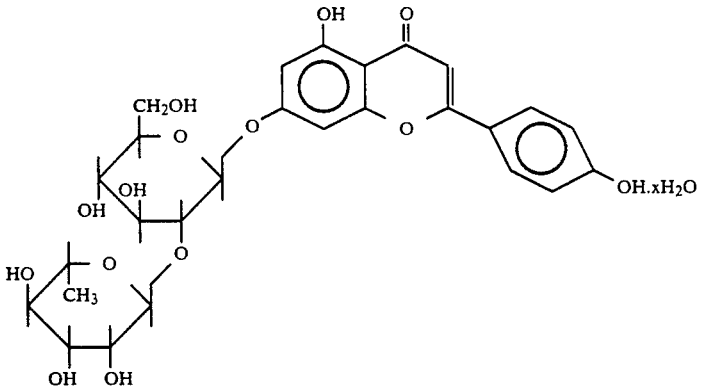

OH.xH2O polyvinyl alcohol Rhodoviol 30-5 (of RHONE POULENC) 20 g

The reaction to acids, Javel water and eraser products with acid reaction (of the "corrector" type) may be obtained by the addition of conventionally known products in the coating solution or in the mass.

EXAMPLE 6

On a paper support, of the same type as that of Example 2, there is deposited on the surface the coating solution containing per liter:

1,8 dihydroxyanthraquinone 5 g

-continued

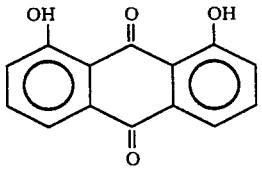

polyvinyl alcohol Rhodoviol 30-5 (R) of RHONE POULENC 20 g

The reactions to the attempts at falsification provoke the following colorations:

pink with acids
red with bases
variable with the solvents, as a function thereof and of the organo-soluble dyes introduced.

EXAMPLE 7

On a paper support containing no safety product, it is possible to obtain a paper slightly shaded in violet, non-fluorescent, unable to be falsified by ink eraser felts and bases, by application of the coating solution containing per liter:

quinizarine 5 g

-continued

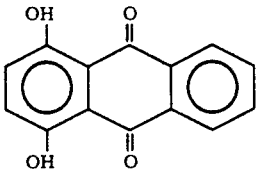

polyvinyl alcohol Rhodoviol 30-5 (R) of RHONE POULENC 20 g

The paper thus treated reacts with the ink eraser felts and bases, developing a marked violet color.

The invention is not limited to the Examples described, as various modifications may be made thereto without departing from its scope.

What is claimed is:

1. A forgery-proof safety paper, comprising, on its surface and/or in its mass, at least one compound responding to formula:

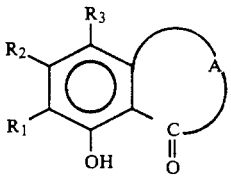

(1)

with:

$R_1$, $R_2$, $R_3$ being either H, OH, or OR,

R being a hydrocarbon chain, substituted or not, straight, rings or aromatic, with A forming one or more cycles, substituted or not wherein said at least one compound is not quinizarin, said forgery-proof safety paper being capable of reacting with a base or reducing agent to develop coloration.

2. The safety paper of claim 1, wherein the compound responding to formula (1) has the following structure:

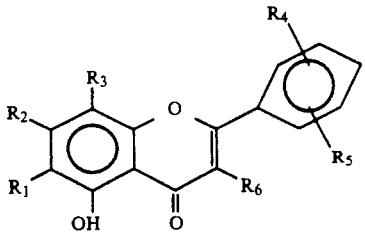

with:

$R_1$ to $R_6$ being either H, OH or OR,

R being a hydrocarbon chain, substituted or not, straight, cyclic or aromatic.

3. The safety paper of claim 1, wherein the compound responding to formula (1) has the following structure:

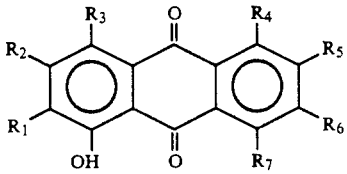

with:

$R_1$ to $R_7$ being either H, OH or OR,

R being a hydrocarbon chain, substituted or not, straight, cyclic or aromatic.

4. The safety paper of claim 1, wherein the compound is selected from the following compounds:

quercetin dihydrate:

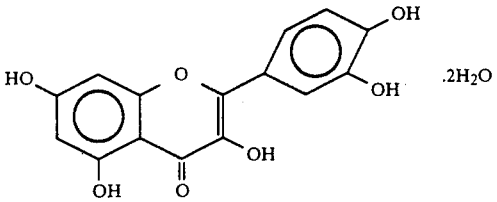

rutin trihydrate:

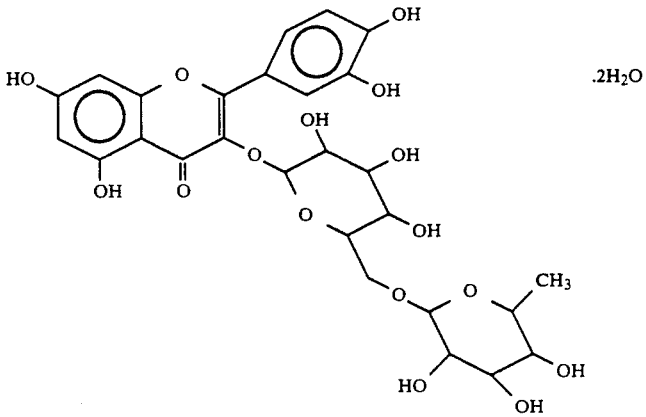

naringin hydrate:

-continued
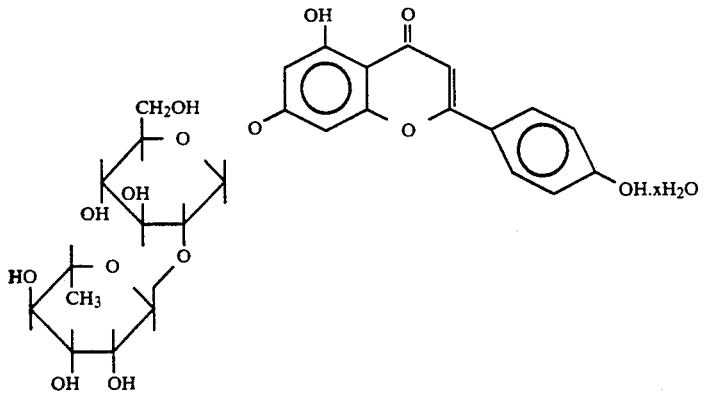
3',5,7 trihydroxy 4' methoxyflavone 7 rutinoside:
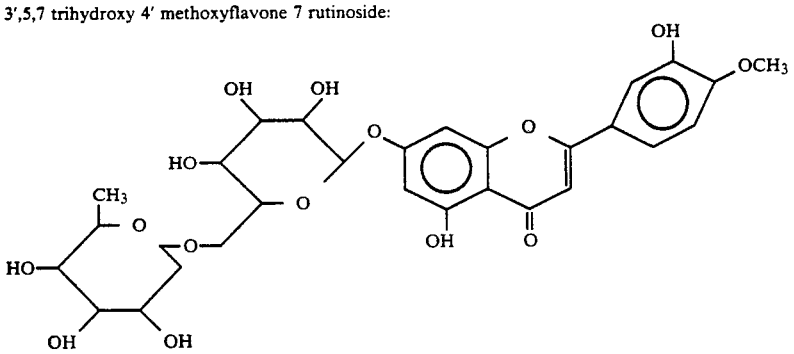
chrysin:
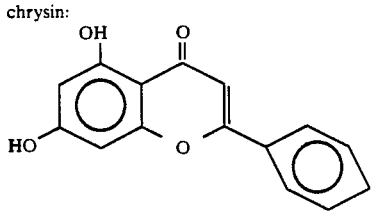
tri (2-hydroxy ethyl) 7,3',4' rutin:
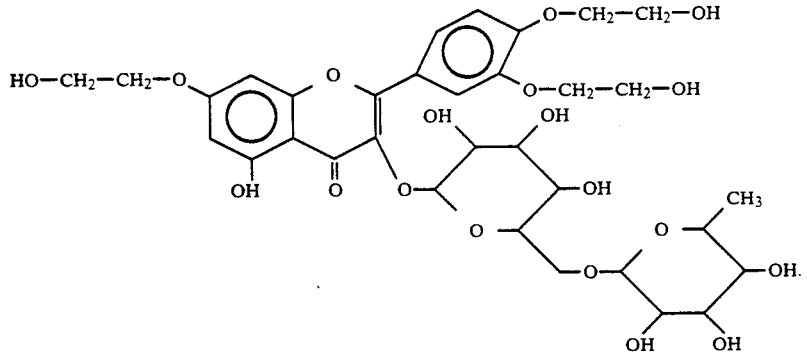
5. The safety paper of claim 3, wherein the compound is selected from the following compounds:
1,8 dihydroxyanthraquinone;
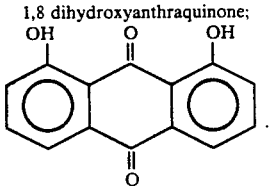
and anthrarufin
-continued
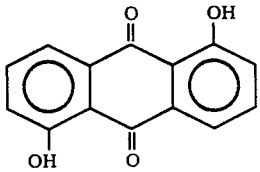
6. The safety paper of claim 1, wherein the paper comprises at least 0.001 g/m$^2$ of the compound of formula (1).

7. The safety paper of claim 6, wherein the paper advantageously comprises between 0.005 and 0.10 g/m$^2$ of the compound of formula (1).

8. A method of rendering a safety paper forgery-proof comprising the steps of providing nonforgery-proof paper; applying to said at least one compound selected from the group consisting of a coating binding, an additive, an organic solvent and at least one compound responding to formula:

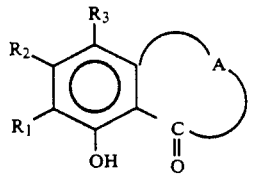

$R_1$, $R_2$, $R_3$ being either H, OH, or OR,

R being a hydrocarbon chain, substituted or not, straight, rings or aromatic, with A forming one or more cycles, substituted or not wherein said at least one compound is not quinizarin, said forgery-proof safety paper being capable of reacting with a base or reducing agent to develop coloration.

* * * * *

UNITED STATES PATENT AND TRADEMARK OFFICE

CERTIFICATE OF CORRECTION

PATENT NO. : 5,264,081

DATED : November 23, 1993

INVENTOR(S) : Honnorat, et al

It is certified that error appears in the above-indentified patent and that said Letters Patent is hereby corrected as shown below:

Column 13, line 67, after "anthrarufin", insert --.--.
Column 14, line 66, "0.001" should read --0.0001--.

Signed and Sealed this

Twelfth Day of July, 1994

Bruce Lehman

*Attest:*

BRUCE LEHMAN

*Attesting Officer*

*Commissioner of Patents and Trademarks*